US006076782A

United States Patent [19]

Alderman

[11] Patent Number: 6,076,782

[45] Date of Patent: Jun. 20, 2000

[54] COLLAPSIBLE SUPPORT FRAME FOR PLASTIC BAG

[76] Inventor: Craig S. Alderman, 1800 Park Ave., #104, Orange Park, Fla. 32073

[21] Appl. No.: 09/219,590

[22] Filed: Dec. 23, 1998

[51] Int. Cl.[7] ..... A63B 55/04

[52] U.S. Cl. ..... 248/97; 248/99

[58] Field of Search ..... 248/97, 99, 153, 248/95, 175, 96, 100; 206/418; 229/55; 220/402, 403

[56] References Cited

U.S. PATENT DOCUMENTS

| | | | |
|---|---|---|---|
| 3,638,888 | 2/1972 | Ross | 248/97 |
| 3,838,839 | 10/1974 | Spencer | 248/99 |
| 3,861,125 | 1/1975 | Hagemeister | 248/99 X |
| 4,705,246 | 11/1987 | Wolf | 248/97 |
| 5,040,754 | 8/1991 | Dearman | 248/97 |
| 5,180,126 | 1/1993 | Bennett | 248/99 |
| 5,411,229 | 5/1995 | Hoefkes | 248/97 |
| 5,413,394 | 5/1995 | Mitchell | 248/1.1 |
| 5,570,862 | 11/1996 | Nugent | 248/97 |
| 5,913,496 | 6/1999 | Valdez | 248/99 |

*Primary Examiner*—Raymond Ramirez
*Assistant Examiner*—Tan Le
*Attorney, Agent, or Firm*—Thomas C. Saitta

[57] ABSTRACT

A support frame for a flexible plastic bag which can support the bag in an open-mouthed manner both upright and sideways, the frame having a pair of legs and pivoting leg/handle, the frame being polygonal and composed of a base member, a pair of end members connected perpendicularly to the base member, a pair of angle members connected at an angle less than 90 degrees to the end members, and a top member connected to the angle members, where the top member is less than half the length of the base member to define a pair of corners which act as tensioning members against the lip of the bag when the leg/handle is pivoted to a position parallel to the frame to prevent the bag from being forced off the frame.

10 Claims, 2 Drawing Sheets

COLLAPSIBLE SUPPORT FRAME FOR PLASTIC BAG

BACKGROUND OF THE INVENTION

This invention relates generally to the field of support frames used to maintain a large, thin-walled, flexible plastic bag, such as a trash or leaf bag, in an open configuration to allow debris and other objects to be easily placed into the bag. More particularly, the invention relates to such devices which are designed to support the bag in an open-mouthed manner both vertically and horizontally, thus allowing leaves and the like to be swept into the bag.

Large, thin-walled plastic bags, typically sized from 30 to 42 or more gallons in capacity, are now the common disposable container used to retain and transport garbage, trash, yard debris, etc. The size of the bags, and the fact that they have no integral support mechanism, makes them difficult to use in many circumstances unless the bag is placed in a container such as a garbage can and the bag mouth stretched around the can perimeter. Where use of the bag with this type of container is not practical, such as when picking up leaves or grass clippings, the user must struggle to maintain the bag mouth open while the debris is loaded, a difficult operation with only one available hand.

To address this problem, a number of self-standing frame devices for plastic bags have been developed. Typically they comprise a wire or PVC tubing frame to receive the bag with legs attached beneath the frame to support the bag in the vertical position. Improved devices allow the frame to be placed sideways on the ground so that the opening is perpendicular to the ground surface, thus making it easier to rake or sweep debris into the bag, sometimes providing a handle to allow the user to control the position of the frame without undue bending. The better versions also provide pivoting connections for the legs and handles so that the device can be folded into a generally flattened configuration for storage. Representative examples of such devices can be seen in U.S. Pat. No. 5,570,862 to Nugent, U.S. Pat. No. 5,413,394 to Mitchell, U.S. Pat. No. 5,411,229 to Hoefkes, U.S. Pat. No. 5,180,126 to Bennett, and U.S. Pat. No. 5,040,754 to Dearman. Mitchell and Bennett show bag holders made of PVC tubing with pivotable handles which allow the user to control the device in the horizontal or sideways position, but lack the additional leg members to support the bag in the upright position, requiring that the frame be leaned against another object to support the bag vertically. Bennett shows a rectangular frame opening and Mitchell shows a D-shaped opening. Dearman shows a complicated wheeled device with a permanent container for the bag having a pivoting leg/handle and two other legs, allowing the device to be used in either the upright or sideways position, where the frame opening has a pentagonal configuration. Nugent shows a simple version having a D-shaped opening and using thin rods as legs which are pushed into the ground to support the frame. All of these patents incorporate additional means to secure the bag to the frame. Nugent uses a pair of D-shaped rods to enclose the bag lip, Dearman mechanically clamps the bag, Mitchell provides a clip on the handle to secure the bag, and Bennett attaches the handle over the bag to secure it.

It is an object of this invention to provide a flexible plastic bag support frame which is an improved design over the known support frames, in that the frame opening is composed of six polygonal segments defining a generally D-shaped opening, with the top frame member being significantly shorter than the base frame member, and having a pivotable leg/handle member attached to the top member, where the design provides a pair of corners adjacent the attachment point of the leg/handle member to better secure the bag to the frame when the leg/handle is pivoted to a position perpendicular to the other leg members without the need for additional securing members, mechanical fasteners, clips or the like. It is a further object to provide such device with a detachable pivoting cover or lid member, the lid configured to match the configuration of the opening and attached by a pair of C-shaped resilient clips.

SUMMARY OF THE INVENTION

The invention is in general a collapsible support frame for a plastic bag, such as a thin-walled trash or leaf bag ranging in size from 30 to 42 gallons or more. The support frame is preferably constructed of PVC tubing and comprises a polygonal frame defining an opening to receive the bag, the frame having a pair of leg members a pivoting leg/handle member attached thereto. The frame has an elongated base member and a much shorter parallel top member, with the top and base members joined by a pair of end members attached perpendicularly to the base member and connected to a pair of angle members which join to the top member, thus defining a generally D-shaped polygonal frame with six corners—preferably two of 90 degrees and four of 45 degrees. Two of the leg members are connected to the base member in a widely separated manner, and the leg/handle member is connected to the center of the top member and doubles as a handle when the device is positioned on its side with the base member resting on the ground, this leg/handle being pivotable to a position perpendicular to the other legs. The bag is attached to the frame by lowering it through the opening with the device in the upright position and then stretching the rim of the bag over the six corners such that the bag is held securely in place by tension. A removable cover is provided, the cover having a polygonal configuration which matches the configuration of the frame. The cover is pivotally connected to the base member by a pair of mounting brackets which are resilient, C-shaped clips, thus allowing the cover to be attached over the bag. The cover can be opened and closed with the bag in place, and can also serve as a ramp for sweeping debris into the bag when the device is laid on the ground sideways. The polygonal shape of the frame insures that the bag remains connected to the frame during use. In particular, the provision of corners adjacent the pivoting connector holding the combination leg/handle insures that the bag will not be forced off the frame when the leg/handle is pivoted flush with the frame opening. Preferably the leg members are pivotally attached as well as the leg/handle member, which enables the device to be folded into a generally flat configuration for storage or transport purposes.

DETAILED DESCRIPTION OF THE INVENTION

With reference to the drawings, the invention will now be described in detail with regard for the best mode and the preferred embodiment. In general, the invention is a support frame for a thin-walled, flexible plastic bag, commonly referred to as trash or leaf bags with capacities of 30 to 42 gallons, more or less, which maintains the bag in an open-mouthed manner. The frame supports the bag in the vertical position, where the bag opening is at the top, or in the sideways or lateral position where the bag opening is on the side, thus allowing debris to be swept or raked into the bag.

Figure 1:
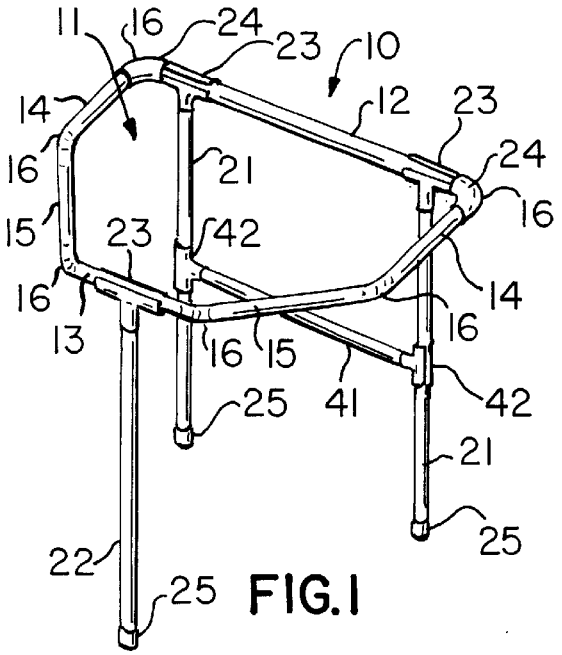
FIG. 1 is a perspective view of the invention in the upright position with no bag in place.
Figure 2:
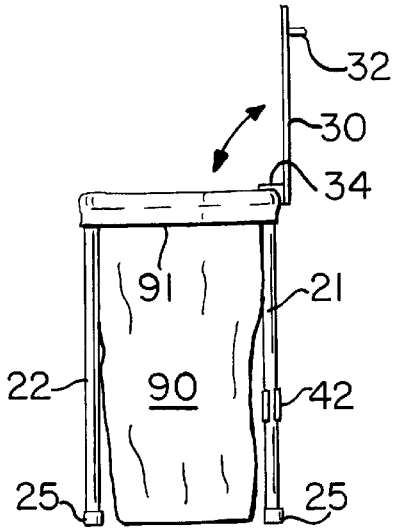
FIG. 2 is a side view of the invention in the upright position with a bag and the lid member attached.
Figure 3:
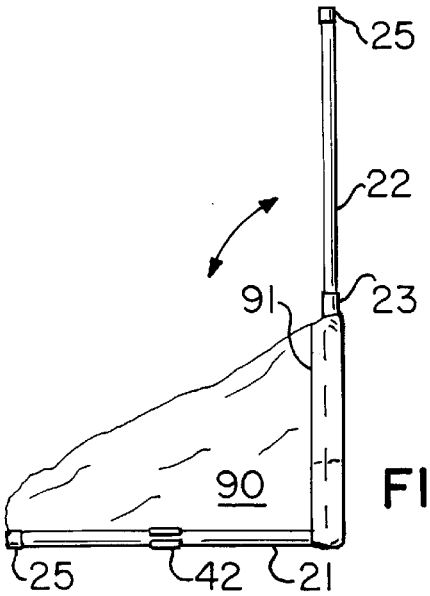
FIG. 3 is a side view of the invention in the sideways or horizontal position with the leg/handle pivoted perpendicular to the other leg members.

As shown in FIGS. 1, 2 and 3, the invention generally comprises a polygonal support frame 10 defining an opening 11, a pair of leg members 21 depending from the frame 10 and a combination leg/handle member 22 also depending from the frame 10, the leg/handle 22 mounted on the opposite side of the frame 10 from the legs 21. The legs 21 and leg/handle 22 are preferably the same length such that the frame 10 is supported in a generally horizontal manner in the upright or vertical position, as seen in FIG. 2. It is preferred that the device be composed of PVC or other rigid plastic tubing, but other suitable materials such as metal or wood could be substituted.

The frame 10 is composed of six linear segments joined such that the defined opening is polygonal. The linear segments comprising the frame 10 are a relatively long base member 12, a pair of short end members 14 perpendicularly attached to the ends of the base member 12, a pair of short angle members 15 joined to the end members, preferably at an angle of 45 degrees, and a top member 13, of a length less than one half the length of the base member 12 and positioned parallel thereto, connected to the angle members 15, such that the combination of all these segments forms a complete perimeter defining a rigid, generally D-shaped, six-sided polygonal opening 11. As shown, it is preferred to create the 45 degree angle junctions between the top member 13, angle members 15 and end members 14 by bending the PVC tubing, which enables these segments to be formed from a single length of tubing, while right angle elbow connectors 24 are used to connect the end members 14 to the base member 12. This configuration provides for six corners 16 spaced about the perimeter of the frame 10. Suitable approximate dimensions for use with a 30 to 42 gallon plastic bag 90 and PVC tubing approximately one inch in diameter are twenty-four inches for the base member 12, six inches for the end members 14, eleven inches for the angle members 15 and nine inches for the top member 13. This polygonally D-shaped configuration for the frame 10 is preferred over square or rectangular frames since the bag openings are circular, and obtaining a good fit is problematical. The polygonal D-shape is preferred over semi-circular D-shaped frames because the bag 90 tends to slip from the semi-circular portion, especially when a pivotal handle is provided which when raised tends to force the bag lip 91 from the frame 10, as is explained in more detail below. The D-shape is preferable to a circular shape, even though the bags 90 are circular, in that the base member 12 provides a linear edge which can be placed onto the ground such that debris can be easily swept or raked into the bag 90, as shown in FIG. 3.

Figure 6:
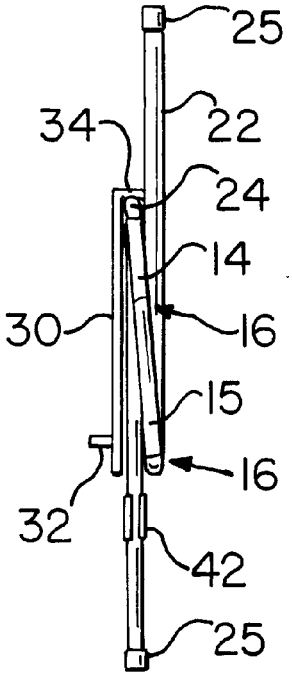
FIG. 6 shows the device in the folded configuration for storage or transport.

The leg members 21 are attached to base member 12 and are preferably spaced widely for better stability. As shown in the drawings they are joined to the base member 12 by connector means 23, which are preferably slotted T-connector members—the lower portion receiving the leg member 21 and the upper portion slotted so that it can be snapped around the base member 12. This provides a pivoting connection, which is preferred in that it allows the device to be folded into a relatively flat configuration for storage or transport, as shown in FIG. 6, by rotating the legs 21 from the position perpendicular to the frame 10. The legs members 21 are preferably provided with end caps or feet 25 so that they are stable on the ground. A brace member 41 may be joined to the mid-section of each leg member 21 by brace connectors 42, also preferably slotted T-connectors, to further stabilize the device. The leg members 21 are preferably about twenty-eight inches in length to support the frame 10 at the optimum height in the upright position.

A combination leg/handle member 22 is pivotally connected to the center of the top member 13 by connector means 23, again preferably a slotted T-connector which can be snapped around the top member 13. Leg/handle member 22 is also preferably provided with a foot 25 and is preferably equal in length to the leg members 21, such that the legs 21 and leg/handle 22 are parallel when the device is used in the upright position. Leg/handle member 22 pivots at least ninety degrees so that the leg/handle member can be moved from the position parallel to the legs 21 and perpendicular to the frame 10, as shown in FIGS. 1 and 2, into a position perpendicular to the legs 21 and parallel to the frame 10, as shown in FIG. 3. In this manner leg/handle member 22 acts as a supporting leg for the upright position and is used as a handle for the sideways position, whereby the user can control the device from a standing position while sweeping or raking debris into the bag 90. The pivotability of leg/handle member 22 also contributes to the flat storage configuration when the device is not in use.

A thin-walled, flexible plastic bag 90 is temporarily affixed to the frame by dropping the bottom of the bag 90 through opening 11 in the frame 10. The rim or lip 91 at the open end of bag 90 is then stretched slightly so that it can be rolled over the full perimeter of frame 10. This is best accomplished by drawing the lip 91 across the right angle corners 16, and then stretching the lip 91 toward the top member 13, pulling the lip 91 over the frame 10 continuously from the base member 12 to the top member 13. The six corners 16 act as tensioning points to better secure the bag 90 as opposed to the circular or semi-circular frame configurations found in other devices. In particular, the corners 16 between the angle members 15 and the top member 13 are of great importance as they are adjacent the pivoting connector means 23 of the leg/handle member 22. These two corners 16 prevent the bag lip 91 from being forced off of the top member 13 when the leg/handle member 22 is rotated to be parallel to the frame 10, as shown in FIG. 3, without the need for additional clips or securing means. The two corners 16 between the angle members 15 and the end members 14 also work in conjunction with the two corners 16 adjacent the leg/handle connector member 23 to better secure the bag lip 91 onto the frame 10 during use.

Figure 4:
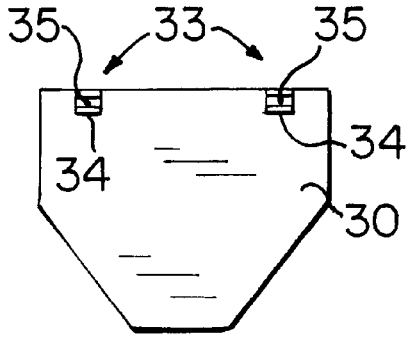
FIG. 4 is a bottom view of the lid member.
Figure 5:
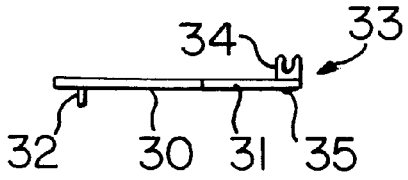
FIG. 5 is a side view of the lid member.

The device may also be provided with a cover or lid member 30 having a perimeter 31 configured to match the configuration of the frame 10 and a handle 32, as shown in FIGS. 4 and 5. The lid 30 is detachably joined to the frame 10 by mounting brackets 33, which preferably comprise a pair of C-shaped resilient clip members 34 affixed to lid 30 by attachment members 35, such as a bolt or screw. The mounting brackets 33 are snapped onto the base member 12 over the bag 90 which is stretched across the frame 10. This secures the lid 30 in a manner which allows it to be opened or closed without having to remove it from the frame 10. At the same time, the mounting brackets 33 further secure the bag 90 to the frame, although they are not required for this purpose. When the device is used in the sideways position with the base member 12 on the ground, the lid 30 may be removed or can be used as a ramp to assist in sweeping or raking debris into the bag 90.

It is contemplated that equivalents and substitutions for certain elements set forth above may be obvious to those skilled in the art, and the true scope and definition of the invention therefore is to be as set forth in the following claims.

I claim:

1. A support frame device for a thin-walled, flexible plastic bag, the device comprising:

a polygonal frame comprising a base member, two end members perpendicularly connected to said base member to define two right angle corners, an angle member connected to each end member at an angle less than 90 degrees to define two additional corners, and a top member connected to both angle members to define two more corners, where said top member is parallel to said base member and is less than half the length of said base member, the combination of said base member, said end members, said angle members and said top member defining a polygonal opening to receive a thin-walled, flexible plastic bag having a lip, where the lip of said bag is stretched across said frame to maintain the bag in an open-mouthed position;

two leg members connected to said base member perpendicularly to said frame;

a leg/handle member pivotally connected to said top member, where said leg/handle member can be positioned parallel to said leg members to support the bag in an upright position or perpendicular to said leg members to be grasped by a user to control the device in a sideways position.

2. The device of claim 1, where the corners connecting said angle members to said end members and said top member are 45 degrees.

3. The device of claim 1, where said leg members are pivotally connected to said base member.

4. The device of claim 1, further comprising connector means to connect said leg/handle member to said top member, where said connector means comprises a slotted T-connector.

5. The device of claim 2, further comprising connector means to connect said leg members to said base member, where said connector means comprises a slotted T-connector such that said lag members are pivotally connected to said base member.

6. The device of claim 1, further comprising a lid detachably fastened to said base member by bracket members, where the bag is disposed between the bracket members and the base member.

7. The device of claim 6, where said bracket members comprise a pair of resilient C-shaped clips.

8. The device of claim 1, where said base member is approximately 24 inches in length, said end members are approximately 6 inches in length, said angle members are approximately 11 inches in length and said top member is approximately 9 inches in length.

9. The device of claim 1, where said leg members and said leg/handle member are the same length.

10. The device of claim 9, where said leg member and said leg/handle member are each approximately 28 inches in length.

* * * * *